US010676854B2

(12) United States Patent
Daniels

(10) Patent No.: US 10,676,854 B2
(45) Date of Patent: Jun. 9, 2020

(54) METHOD AND SYSTEM FOR DISPENSING LAUNDRY CHEMISTRY BASED UPON OZONE CONCENTRATION

(71) Applicant: AWOIS, LLC, Auburn, NH (US)

(72) Inventor: Ralph G. Daniels, Auburn, NH (US)

(73) Assignee: AWOIS, LLC, Auburn, NH (US)

( * ) Notice: Subject to any disclaimer, the term of this patent is extended or adjusted under 35 U.S.C. 154(b) by 305 days.

(21) Appl. No.: 15/690,550

(22) Filed: Aug. 30, 2017

(65) Prior Publication Data

US 2019/0062980 A1 Feb. 28, 2019

(51) Int. Cl.
*D06F 33/02* (2006.01)
*D06F 35/00* (2006.01)
(Continued)

(52) U.S. Cl.
CPC ..... *D06F 39/02* (2013.01); *D06F 35/001* (2013.01); *D06F 37/04* (2013.01); *D06F 33/00* (2013.01); *D06F 34/28* (2020.02); *D06F 39/022* (2013.01); *D06F 2202/02* (2013.01); *D06F 2202/12* (2013.01); *D06F 2204/02* (2013.01); *D06F 2204/086* (2013.01)

(58) Field of Classification Search
CPC ..... D06F 33/02; D06F 35/001; D06F 37/04; D06F 39/005; D06F 39/02; D06F 39/022; D06F 2202/02; D06F 2202/12; D06F 2204/02; D06F 2204/086
USPC .... 8/158, 159; 68/3 R, 13 R, 17 R, 183, 207
See application file for complete search history.

(56) References Cited

U.S. PATENT DOCUMENTS 5,806,120 A 9/1998 McEachem
5,960,649 A 10/1999 Burdick
(Continued)

FOREIGN PATENT DOCUMENTS

GB 2464217 A 4/2010

OTHER PUBLICATIONS

International Search Report issued in corresponding International Patent Application No. PCT/US18/48828 dated Feb. 12, 2019.
(Continued)

*Primary Examiner* — Levon J Shahinian
(74) *Attorney, Agent, or Firm* — Davis & Bujold PLLC; Michael J. Bujold

(57) ABSTRACT

Method and system for system for controlling dispensing of laundry chemistry from a laundry chemistry dispenser to a washing machine to minimize use of the laundry chemistry. The method and the system comprise an ozone monitor for determining a current ozone concentration level in the washing machine at a time that the washing machine requires dispensing of the laundry chemistry from the laundry chemistry dispenser; a control panel being coupled to the ozone monitor for receiving a signal indicative of the currently determined ozone concentration level in the washing machine; and the control panel is coupled to the laundry chemistry dispenser for controlling a dispensing operation of the laundry chemistry from the laundry chemistry dispenser based upon the currently determined ozone concentration level in the washing machine. When the ozone concentration level is low, less laundry chemistry is dispensed while when the level is high, more laundry chemistry is dispensed.

18 Claims, 6 Drawing Sheets

(51) Int. Cl.

| | |
|---|---|
| ***D06F 37/04*** | (2006.01) |
| ***D06F 39/00*** | (2020.01) |
| ***D06F 39/02*** | (2006.01) |
| *D06F 33/00* | (2020.01) |
| *D06F 34/28* | (2020.01) |

(56) References Cited

U.S. PATENT DOCUMENTS

| | | | | |
|---|---|---|---|---|
| 9,587,339 | B2 | 3/2017 | Goshgarian et al. | |
| 2003/0196278 | A1 | 10/2003 | Durfee | |
| 2005/0268404 | A1 | 12/2005 | Laithwaite | |
| 2012/0070352 | A1* | 3/2012 | Eglmeier ..... | D06F 35/001 423/219 |
| 2014/0033445 | A1 | 2/2014 | Daniels et al. | |
| 2015/0033805 | A1 | 2/2015 | Rupnow | |

OTHER PUBLICATIONS

Written Opinion issued in corresponding International Patent Application No. PCT/USI8/48828 dated Feb. 12, 2019.

* cited by examiner

METHOD AND SYSTEM FOR DISPENSING LAUNDRY CHEMISTRY BASED UPON OZONE CONCENTRATION

FIELD OF THE INVENTION

The present invention relates to a method and a system for accurately determining the amount of laundry detergent (e.g., chemistry) which is to be added to laundry in order to adequately and sufficiently cleaning the laundry being washed, with the amount of added laundry detergent (e.g., chemistry) being inversely proportional to the current ozone concentration level, contained within the washing machine, at the time that the washing machine requires dispensing of laundry detergent (e.g., chemistry) to the laundry or after a preset period of time following the first introduction of ozone into the washing machine.

BACKGROUND OF THE INVENTION

The use of ozone in cleaning and sanitizing laundry has been utilized for quite some time. The primary reason is that ozone is generally recognized as being effective in cleaning as well as deodorizing and sanitizing laundry while also minimizing the impact to the environment. With respect to commercial applications, however, ozone is generally the preferred cleaning component as it is relatively inexpensive to manufacture and quite reliable in deodorizing and sanitizing laundry being washed.

As is well known, the application of ozone to a cleaning fluid, such as water, acts as a disinfectant as well as assists with removing dirt, debris, soil and other contaminants from the laundry detergent so that the laundry detergent can again be effective in removing additional dirt, debris, soil and other contaminants from the clothing or other laundry being washed. While it is known that dissolving ozone in a liquid, such as water, will assist with improving the cleaning and sterilization efficiency of the liquid, a number of the currently available prior art systems suffer a variety of associated drawbacks.

It is to appreciated that washing laundry can be a relatively expensive process. It utilizes costly resources—water, energy, laundry detergents and labor—and such laundering is often required not only to clean but completely disinfect and sanitize the items being laundered. While conventional detergents, soap and chemistry can be effective in removing dirt, grease, grime and other contaminants, they are not always effective in killing all of the germs and bacteria contained within the laundry. It is known to enhance the disinfection capabilities of a washing machine by introducing ozone into the washing water. The ozone improves cleaning of laundry, even at relatively low or cold wash water temperatures, and also has an antibacterial effect.

It is to be appreciated that a desired amount of laundry detergent (e.g., chemistry) generally must be added to the washing machine in order to ensure that the laundry being washed, in addition to being sanitized and disinfected, is also sufficiently and adequate cleaned. As is conventional in the prior art, an operator or an automated dispensing device typically adds a standard dose or set amount of laundry detergent (e.g., chemistry) to the washing machine while washing the laundry. However, in the event that the laundry is relatively clean, e.g., only slightly soiled, in substantially all washing applications, an excessive amount of laundry detergent (e.g., chemistry) is thus added to the laundry being washed which results in wasted laundry detergent (e.g., chemistry). On the other hand, if the laundry is relatively dirty, e.g., excessively soiled, then an insufficient amount of laundry detergent (e.g., chemistry) may possibly be added to the laundry being washed thereby preventing the laundry from being sufficiently cleaned following completion of the entire wash cycle.

SUMMARY OF THE INVENTION

Wherefore, it is an object of the present invention to overcome the above mentioned shortcomings and drawbacks associated with the prior art laundry detergent (e.g., chemistry) dispensing systems and provide a laundry detergent (e.g., chemistry) dispensing system which automatically adds the correct and proper amount of laundry detergent (e.g., chemistry) to the laundry being washed to adequately clean the laundry so as to avoid wasting laundry detergent (e.g., chemistry).

Another object of the invention is to determine the current amount of ozone contained within the wash water, either at the time that the washing machine requests the dispensing of laundry detergent (e.g., chemistry) into the laundry being washed or possibly after a predetermined time period following the first introduction of ozone to the washing machine, and then use the current ozone concentration level to adjust/regulate the amount of laundry detergent (e.g., chemistry) which is added to the laundry being washed in order to facilitate both adequate disinfection and sufficient cleaning of the laundry being washed while still avoiding the dispensing of excess laundry detergent (e.g., chemistry) to the laundry.

Yet another object of the present invention is to determine automatically the precise amount of laundry detergent (e.g., chemistry), which is to be added to the laundry being washed, based upon how slowly or rapidly the ozone concentration level, within the washing machine, rises in order to conserve the use of laundry detergent (e.g., chemistry) while still ensuring adequately cleaning and sanitation of the laundry being washed.

A still further object of the invention is to provide an automated laundry detergent dispenser which dispenses a precise amount of laundry detergent (e.g., chemistry) into the washing machine, based the current ozone concentration level within the washing machine at the time that laundry detergent (e.g., chemistry) is requested by the washing machine, to assist with sufficient cleaning of the laundry being washed.

The present invention also relates to a system for controlling dispensing of laundry chemistry from a laundry chemistry dispenser to a washing machine in order to minimize use of the laundry chemistry during a wash, the system comprising: an ozone monitor for determining a current ozone concentration level in the washing machine at a time that the washing machine requires dispensing of the laundry chemistry from the laundry chemistry dispenser; a control panel being coupled to the ozone monitor for receiving a signal indicative of the currently determined ozone concentration level in the washing machine; and the control panel being coupled to the laundry chemistry dispenser for controlling a dispensing operation of the laundry chemistry from the laundry chemistry dispenser which adjusts the amount of the laundry chemistry to be dispensed based upon the currently determined ozone concentration level in the washing machine.

The present invention also relates to a system for controlling dispensing of laundry chemistry from a laundry chemistry dispenser to a washing machine in order to minimize use of the laundry chemistry during a wash, the system comprising: an ozone monitor for determining a current ozone concentration level in the washing machine at a time that the washing machine requires dispensing of the laundry chemistry from the laundry chemistry dispenser; a control panel being coupled to the ozone monitor for receiving a signal indicative of the currently determined ozone concentration level in the washing machine; and the control panel also being coupled to the laundry chemistry dispenser for controlling a dispensing operation of the laundry chemistry from the laundry chemistry dispenser, and the dispensing operation of the laundry chemistry from the laundry chemistry dispenser being controlled based upon the determined current ozone concentration level in the washing machine such that when the current ozone concentration level in the washing machine is determined to be relatively low, a greater amount of the laundry chemistry is dispensed from the laundry chemistry dispenser to the washing machine, while when the current ozone concentration level in the washing machine is determined to be relatively high, a lesser amount of the laundry chemistry is dispensed from the laundry chemistry dispenser to the washing machine.

The present invention further relates to an automated method of controlling dispensing of laundry chemistry from a laundry chemistry dispenser to a washing machine in order to minimize use of the laundry chemistry, the method comprising: loading laundry to be washed into the washing machine; adding water to the washing machine; commencing a supply of ozone, from an ozone source, to the water contained within the washing machine; detecting, via an ozone monitor, a current ozone concentration level in the washing machine at a time that the washing machine requires dispensing of the laundry chemistry from the laundry chemistry dispenser; and adjusting an amount of the laundry chemistry to be dispensed from the laundry chemistry dispenser to the washing machine based upon the currently detected ozone concentration level such that a greater amount of the laundry chemistry is dispensed from the laundry chemistry dispenser to the washing machine when the current ozone concentration level in the washing machine is relatively low, while a lesser amount of the laundry chemistry is dispensed from the laundry chemistry dispenser to the washing machine when the current ozone concentration level in the washing machine is relatively high.

As used within the specification and the appended claims, the term "current ozone concentration level" means the ozone concentration which is currently measured either directly within the washing machine or currently measured in a gas flow discharging directly from an opening or other vent from the washing machine.

As used within the specification and the appended claims, the term "washing machine" means both front and top loading conventional washing machines as well as a tunnel or a continuous batch washer.

As known in the industry, there is a direct correlation between the amount of dirt, grime, soil, germs, bacteria, etc., contained within the laundry being washed and the amount of ozone which is required to adequately treat such dirt, grime, soil, germs, bacteria, etc. This correlation is commonly used to refer to in the industry as "ozone demand," i.e., the more dirt, grime, soil, germs, bacteria, etc., the greater the ozone demand.

BRIEF DESCRIPTION OF THE DRAWINGS

Preferred embodiments of the present invention will now be described, by way of example only and not in any limitative sense, with reference to the appended drawings in which.

DETAIL DESCRIPTION OF THE DRAWINGS

Figure 1:
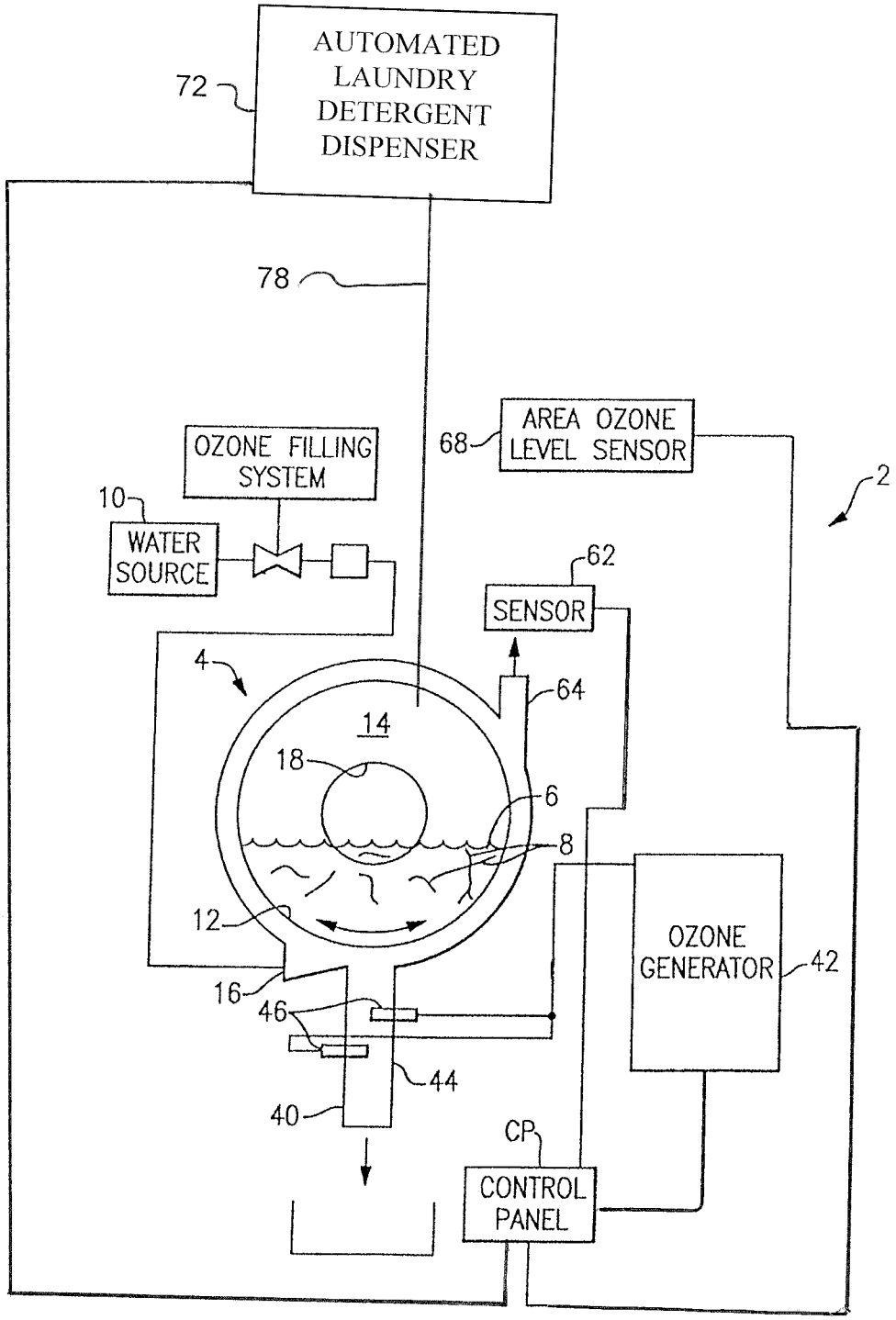
FIG. 1 shows the improved system, according to an embodiment of the present invention, for controlling a supply of ozone to a washing machine both during the filling phase as well as during each subsequent wash cycle(s)
Figure 2:
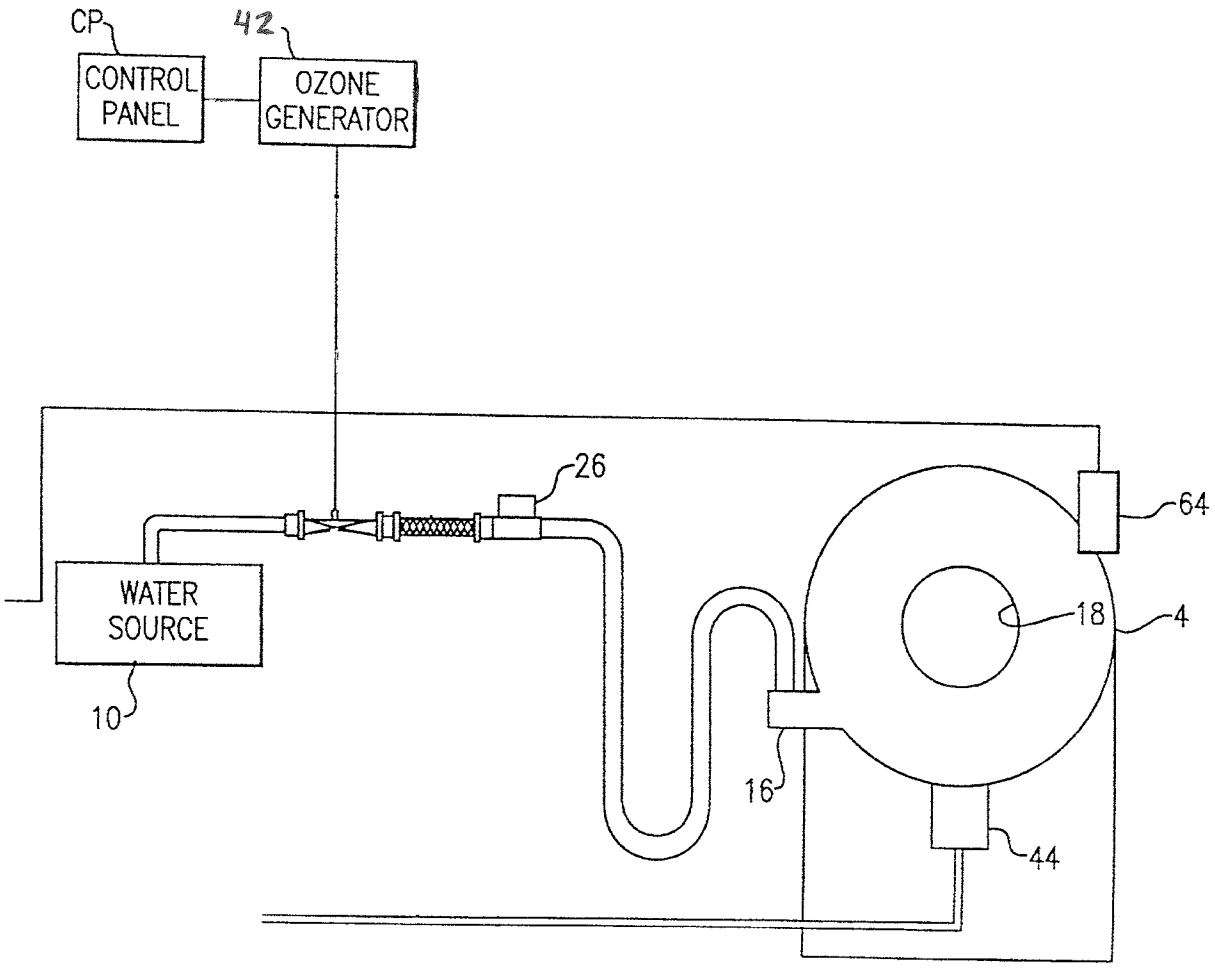
FIG. 2 is an enlarged diagrammatic drawing showing venturi and static mixed components for intermittently mixing the fresh water with the ozone to provide a substantially uniform mixture thereof which assists with retaining the ozone within the water for a longer duration of time once the ozonated water is supplied to the washing machine.

With reference now to FIGS. 1 and 2, a detailed description concerning the present invention will now be discussed in detail. In the following description, a detail description will first be provided concerning the basic components of the washing machine and, thereafter, a detail description concerning the system for controlling dispensing of laundry chemistry to the laundry being washed will be provided.

As can be seen in FIG. 1, a washing machine 4 which, during use, is filled with a suitable volume of liquid or wash water 6, i.e., a washing volume of water, to facilitate washing of the laundry being washed 8 and contained within the washing machine 4. The water is typically supplied from a water supply source 10 to either a sump 44 or a lower most portion of a rotatable internal drum 12, located within an internal chamber 14 of the washing machine 4, via a fresh water supply inlet 16. Also as is conventional in the art, the washing machine 4 is provide with a hinged door 18 (only diagrammatically shown), typically located on either the front or the top surface of the washing machine 4, that generally forms a water tight seal with the door opening of the washing machine 4, in a conventional manner, when the door 18 is latched in a closed position (in FIG. 1 the door is diagrammatically shown in the front of the washing machine 4). The door 18, when in its opened position, facilitates adding and removing the laundry to be washed 8 from the washing machine 4. As such door and its associated latching mechanism are conventional and well known in the art, a further detailed discussion concerning the same is not provided.

During the initial as well as any subsequent filling cycle, when washing the laundry being washed 8, the filling water flows from the water supply source 10, along a filling water conduit 21 into the washing machine 4. A water supply valve 26 (see FIG. 2), which controls the flow of filling water to the washing machine 4, is electrically coupled and controlled by the control panel CP. The system 2 includes an ozone source or generator 42 which supplies or produces a desired amount of ozone during operation of the washing machine 4. The source or ozone generator 42 is electrically connected to the control panel CP, as described below in further detail, and generally facilitates control of the flow of ozone from the ozone source or generator 42. It is to be appreciated that the supply of ozone from the ozone source or generator 42, according to the present invention, may be controlled by the control panel CP in order to (e.g., gradually) increase or decrease the supply of ozone, as required by the system 2. That is, as the ozone concentration level in the washing machine approaches the desired ozone concentration level or target valve, e.g., 1.0 to 15.0 parts per million (ppm) for example, the control panel CP can gradually decrease the supply of ozone, from the ozone source or generator 42, so as to avoid supplying excess ozone to the washing machine 4, while if the ozone concentration level in the washing machine commences falling below the desired ozone concentration level or target value, e.g., 1.0 to 15.0 parts per million (ppm), the control panel CP can gradually increase the supply of ozone, from the source or ozone generator 42 to the washing machine 4, so as attempt to maintain the ozone level, within the washing machine 4, at, or just below, the desired ozone concentration level or target value.

It is to be appreciated that a commercial washer typically includes up to, and including, 8 separate wash stages or cycles, but it is to be appreciated the number and duration of the wash stages or cycles can vary from washing machine to washing machine or application to application. During each one of the wash stages or cycles, a portion of the water contained within the internal drum 12 of the washing machine 4, e.g., typically between about 30% to about 70% of the wash water, may be discarded or discharged from the washing machine 4 and subsequently replaced a quantity of fresh filling water to facilitate further washing of the laundry being washed 8. Each time fresh filling water is supplied to the washing machine 4, such fresh filling water may be subsequently supplied with additional ozone from the ozone source or generator 42 while the water is located within the washing machine 4, and the amount of supplied ozone is normally controlled by the control panel CP in order to maintain, as much as possibly, the desired ozone concentration level or target value within the washing machine 4.

In order to minimize the amount of ozone that rapidly gasses off from and out of the water, the ozone or ozonated water is preferably supplied to a lower most region or portion of the internal drum 12 of the washing machine 4. By supplying the ozone and/or ozonated water in this manner, any ozone which has a tendency to be "gassed off," while being discharged into the internal drum 12, still must bubble and/or permeate up through the water and the laundry contained within the washing machine 4 and thus still has a tendency to facilitate intimate contact with the laundry being washed 8 thereby still achieving some cleaning, sterilization and/or sanitization of the laundry being washed 8 prior to such gassed off ozone eventually exhausting from the washing machine 4 out through an exhaust vent 64, for example, as described below in further detail, or any other vent(s), port(s) or opening(s) provided in the washing machine 4.

Figure 3:
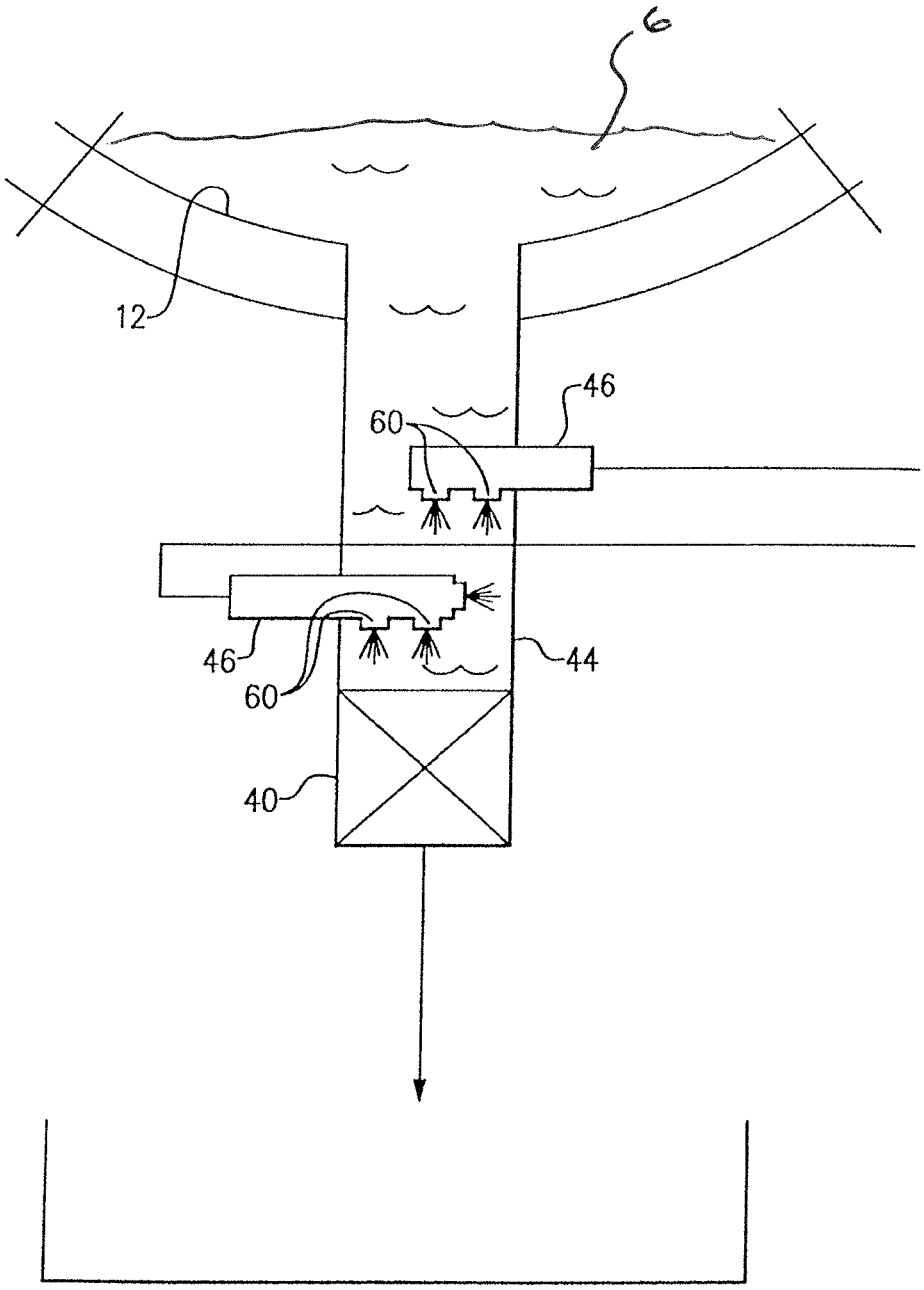
FIG. 3 shows injection of the ozone into the sump via the sparger injection nozzles.

Prior to filling the washing machine 4 with filling water, as shown in FIG. 3, a drain valve 40 is closed to facilitate retention of the filling water 6 to be supplied to the internal chamber 14 of the internal drum 12 of the washing machine 4 from the water supply source 10. Either during or after filling of the washing machine 4 with water 6, the ozone source or generator 42 commences the supply of ozone which is typically injected into the sump 44 of the washing machine 4, via at least one and generally two or more (typically downwardly facing) spargers 46, where the ozone is discharged directly into the water 6 contained within the sump 44. It is to be appreciated that not all washing machines 12 have a sump and, in such instance, the ozone may merely be injected into the wash water 6 located within a lower most region of the washing machine 12.

Preferably each of the spargers 46 has one or more injector nozzles 60 which inject the ozone downwardly toward the drain valve 40 of the washing machine 4 to facilitate enhanced suspension, entrainment, encapsulation, dispersion and/or mixing of the supplied ozone with and in the water 6 contained within the sump 44 and thereby provide a more uniform mixture and dispersion of the ozone within and throughout the water 6 contained within the sump 44 as well as within and throughout the water 6 contained within the washing machine 4. The water 6 and the dissolved ozone are then agitated, during normal operation of the washing machine 4, and, due to such to and fro agitating motion of the internal drum 12, intimately mix and disperse the ozone, supplied via the spargers 46, throughout the entire volume of water 6 contained within the internal drum 12 of the washing machine 4 so that the ozone is readily able to contact and react with the laundry soap or detergent (e.g., chemistry) 70, once added to the wash machine 4 as discussed below, as well as with any dirt, grime, soil, germs, bacteria, etc., contained within the laundry being washed 8.

The supplied ozone typically has a particle size of about 2 microns to 20 microns such that some of the ozone is not readily dissolved, to any substantial extent, in the water 6 contained in the sump 44 but is encapsulated, suspended, dispersed and/or entrained within the water 6 and thus the ozone, in gaseous form, is readily available for reacting with any dirt, soil, grime, grease, germs, bacteria, etc., contained in the laundry being washed 8 by the washing machine 4. As is conventional, the ozone will only typically last for a relatively short period of time, e.g., possibly anywhere between about 2 to about 20 minutes or so and typically last between about 3 and 5 minutes, before the ozone naturally converts back into oxygen and thus loses its disinfectant and/or sanitization capability.

Figure 1A:
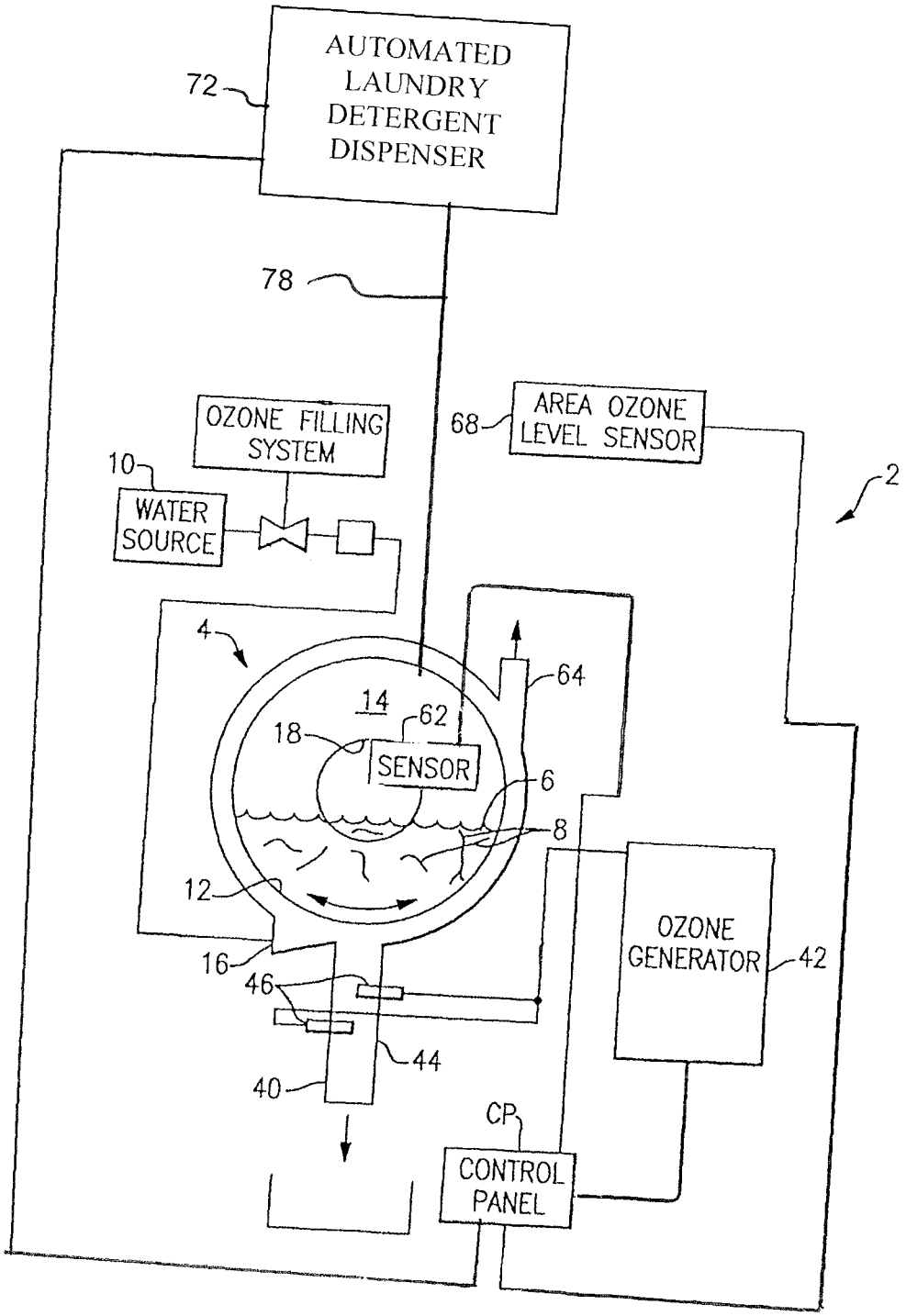
FIG. 1A shows a modification to the improved system of FIG. 1 where the ozone monitor is directly located within the washing machine.

To monitor and/or determine the amount of ozone in the washing machine 4, an ozone exhaust or sampling detector or sensor 62 may be located immediately adjacent or near one of the conventional exhaust vent(s), port(s) or outlet(s) 64 of the washer machine 4, such as a soap vent, a soap chute, an air bleed-off vent, etc. Alternatively, as shown in FIG. 1A, the ozone exhaust or sampling detector or sensor 62 can be either located directly within the washing machine 4, e.g., within the internal chamber 14, or directly connected to a sampling outlet or aperture (not shown) for periodically sensing, possibly withdrawing via a fan, a sample of gas from the washing machine 4. The important aspect is that the ozone exhaust or sampling detector or sensor 62 accurately measures the ozone concentration level currently contained within the washing machine 4. Once the current ozone concentration level of the washing machine 4 is detected by the ozone exhaust or sampling detector or sensor 62, the withdrawn and detected sample can then either be discarded or possibly return back to the washing machine 4. If desired, a small fan 38 may be located in or adjacent the vent(s), port(s) or opening(s) in the washing machine 4 to assist with drawing off ozone, which bubbles and/or permeates up through the water, and removing a small portion or sample thereof from the washing machine 4 for determining the current ozone concentration level of the washing machine 4.

The ozone exhaust or sampling sensor 62 either directly communicates with or is typically located within or as close as possible to the sampling or exhaust outlet(s) 64 so as to obtain a substantially undiluted sample of the ozone being sampled, removed or exhausted from the washing machine 4. The ozone exhaust or sampling sensor 62 will monitor the withdrawn sample or the air escaping or exhausting from the washer machine 4, during operation thereof, to detect the concentration level of ozone currently contained therein. In the event that the current ozone concentration level of the air sampled or exhausting from the washing machine 4 is above an ozone target value, e.g., above a target value of 1.0±0.5 parts per million for example, then the ozone exhaust or sampling sensor 62 will then convey a signal to the control panel CP which, in turn, can control and decrease the supply of ozone from the ozone source or generator 42 so as to decrease the supply of ozone until the ozone exhaust or sampling sensor 62 eventually detects a level of ozone within the washing machine 4 which is approaching, at or below the target value, e.g., detects an ozone level in the escaping air of around 1.0 parts per million, for example. During all of the wash cycles, the control panel CP can operate to continuously and constantly control, e.g., increase, decrease or maintain, the supply of ozone from the ozone source or generator 42 so that the concentration level of ozone, contained within the washing machine 4, is maintained at or around the target value, e.g., 1.0 parts per million.

According to the invention, the control panel CP (or possibly a separate CPU which is coupled to so as to communicate with the control panel CP), upon receipt of the signal from the washing machine 4 indicating that the washing machine 4 now desires the dispensing of laundry detergent (e.g., chemistry) 70 to the laundry being washed 8, the control panel CP (or possibly the separate CPU) then obtains a current ozone concentration reading from the ozone exhaust or sampling detector or sensor 62 which indicates the currently detected ozone concentration level in the washing machine 4. The control panel CP (or possibly the separate CPU) then utilizes this signal, received from the ozone exhaust or sampling detector or sensor 62, as discussed below in further detail, to adjust or modify, as necessary, the amount of laundry detergent (e.g., chemistry) 70 which is to be dispensed and added to the laundry being washed 8 in order to ensure adequate cleaning thereof while, at the same time, avoiding the dispensing of excess laundry detergent (e.g., chemistry) 70 to the laundry being washed 8. That is, the control panel CP (or possibly the separate CPU), based upon the received signal from the ozone exhaust or sampling detector or sensor 62, sends a corresponding control signal to the automated laundry detergent dispenser 72 which correspondingly adjusts or modifies, as necessary, the amount of laundry detergent (e.g., chemistry) 70 which is to added to the laundry being washed 8.

For example, if the currently detected ozone concentration level within the washing machine 4 is at, or possibly below, a minimum ozone concentration level, e.g., between 0.005 and 0.03 parts per million typically about 0.01 parts per million, at the time when the laundry detergent (e.g., chemistry) 70 is requested by the washing machine 4, then generally no modification to the amount of laundry detergent (e.g., chemistry) 70 to be added to the laundry being washed 8 occurs. That is, if the currently detected ozone concentration level is at, or possibly below, the minimum ozone concentration level, then the laundry being washed 8 is determined to be sufficiently soiled/dirty, due to the "relatively low" currently detected ozone concentration level at the time when laundry detergent (e.g., chemistry) 70 is requested, and thereby requires dispensing of a standard or normal dose of laundry detergent (e.g., chemistry) 70, i.e., an initially predetermined amount, to the laundry be washed 8 in order to ensure sufficient cleaning thereof.

However, if the currently detected ozone concentration level within the washing machine 4 is above the minimum ozone concentration level at the time when the laundry detergent (e.g., chemistry) 70 is requested by the washing machine 4, then some modification of the amount of laundry detergent (e.g., chemistry) 70 to be added by the automated laundry detergent dispenser 72 to the laundry being washed 8 occurs. That is, in this instance, due to the "relatively higher" ozone concentration level currently contained within the washing machine 4, the laundry being washed 8 is determined to be less soiled/dirty and thus requires dispensing of proportionally less than a normal dose of laundry detergent (e.g., chemistry) 70 to the laundry be washed 8 in order to ensure sufficient cleaning thereof.

It is to be appreciated that the greater the currently detected ozone concentration level is above the minimum ozone concentration level, the lesser the amount of laundry detergent (e.g., chemistry) 70 which is required to be added to the laundry being washed 8 (i.e., the larger the reduction in the amount of laundry detergent (e.g., chemistry) 70 to be added) in order to adequately cleaned the laundry being washed 8. As noted above, if the currently detected ozone concentration level is at, or possibly below, the minimum ozone concentration level (see point A in FIG. 4), then the automated laundry detergent dispenser 72 will have a 0% reduction in the amount of laundry detergent (e.g., chemistry) 70 to be dispensed, i.e., the automated laundry detergent dispenser 72 will dispense approximately 100% of the normal dose of the laundry detergent (e.g., chemistry) 70 or the automated laundry dispenser 72 will operate for approximately 100% of its typical dispensing cycle to dispense the laundry detergent (e.g., chemistry) 70 to laundry 8 being washed.

Conversely, if the currently detected ozone concentration level is at an upper ozone concentration level (see point B in FIG. 4), then the automated laundry detergent dispenser 72 will have approximately a 50% reduction in the amount of laundry detergent (e.g., chemistry) 70 to be dispensed, i.e., the automated laundry detergent dispenser 72 will only dispense approximately 50% of the normal dose of the laundry detergent (e.g., chemistry) 70 or the automated laundry dispenser 72 will only operate for approximately 50% of its typical dispensing cycle for dispensing the laundry detergent (e.g., chemistry) 70 to laundry 8 being washed. Correspondingly, if the currently detected ozone concentration level is in between the upper ozone concentration level and the minimum ozone concentration level (see point C in FIG. 4 for example), then the automated laundry detergent dispenser 72 have approximately a 30% reduction in the amount of laundry detergent (e.g., chemistry) 70 to be dispensed, i.e., the automated laundry detergent dispenser 72 will only dispense approximately 70% of the normal dose of the laundry detergent (e.g., chemistry) 70 or the automated laundry dispenser 72 will only operate for approximately 70% of its typical dispensing cycle for dispensing the laundry detergent (e.g., chemistry) 70 to laundry being washed.

The minimum ozone concentration level and the upper ozone concentration level, for the currently detected ozone concentration level in the washing machine 4, define an ozone adjustment band within which the amount of the laundry detergent (e.g., chemistry) 70 to be dispensed to the laundry being washed 8 is proportionally adjusted. If the currently detected ozone concentration level in the washing machine 4 is below the minimum ozone concentration level, then no adjustment of amount of the laundry detergent (e.g., chemistry) 70 to be dispensed occurs, and if the currently detected ozone concentration level in the washing machine 4 is above the upper ozone concentration level, then no adjustment of amount of the laundry detergent (e.g., chemistry) 70 to be dispensed occurs. Adjustment of the amount of the laundry detergent (e.g., chemistry) to be dispensed only occurs when the currently detected ozone concentration level in the washing machine is located within in the ozone adjustment band, i.e., between the minimum ozone concentration level and the upper ozone concentration level.

Figure 4:
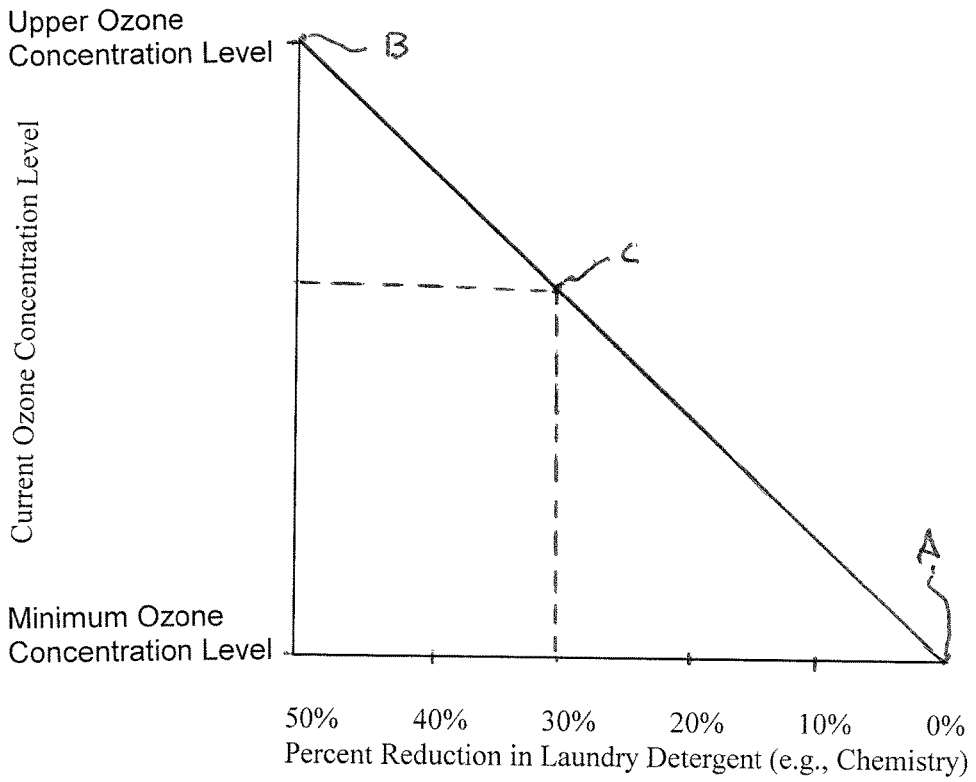
FIG. 4 is a graph showing the inverse relationship between the current ozone concentration level in the washing machine and the percent reduction in the amount of laundry detergent (e.g., chemistry) to be added to the washing machine.
Figure 5:
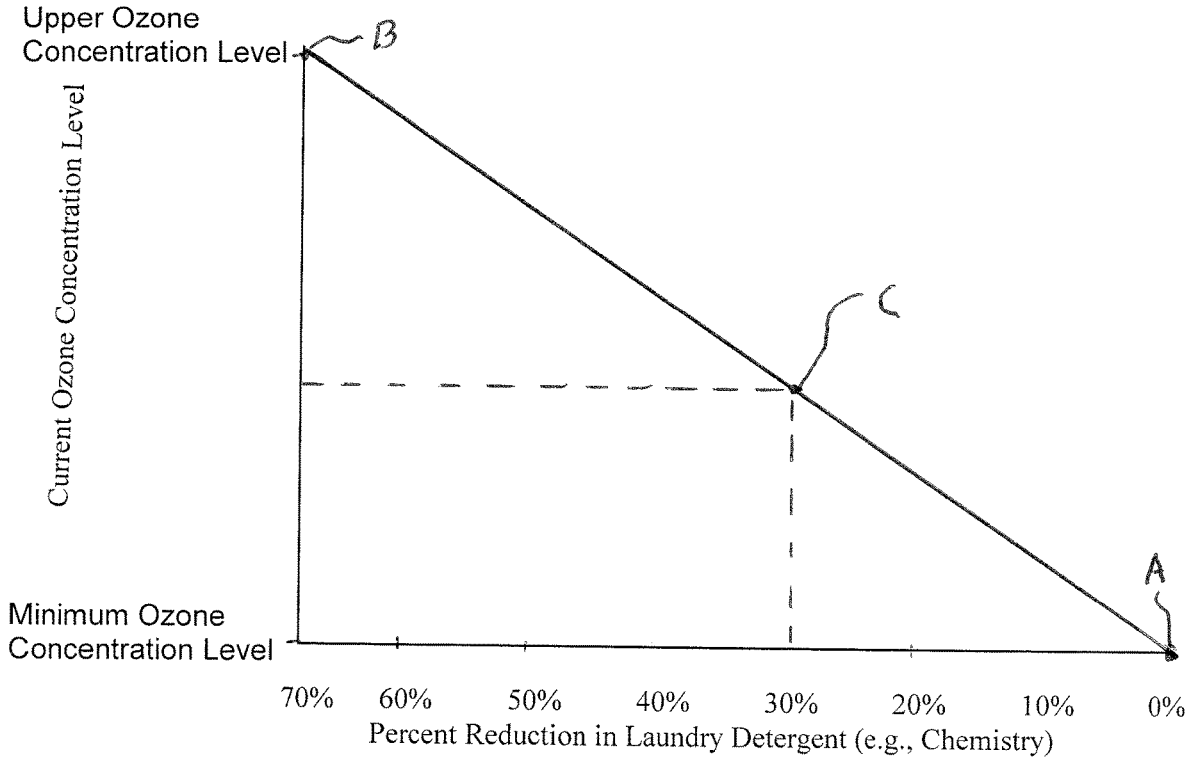
FIG. 5 is a graph, similar to FIG. 4, showing a variation of the inverse relationship between the current ozone concentration level in the washing machine and the percent reduction in the amount of laundry detergent (e.g., chemistry) to be added to the washing machine.

FIG. 5 is a variation of the graph shown in FIG. 4 in which the percent reduction range, in the amount of laundry detergent (e.g., chemistry) 70 to be added, is increased in this example and ranges from 0% to 70%. It is to be appreciated that 1) the minimum ozone concentration level, 2) the ozone target valve, and 3) the percent reduction range in the amount of laundry detergent (e.g., chemistry) 70 to be added to the laundry being washed can vary from application to application, without departing from the spirit and scope of the present invention. The important aspect is that, within the ozone adjustment band, as the ozone concentration level within the washing machine increases, there will be a corresponding decrease in the amount of laundry detergent (e.g., chemistry) 70 that is added to the laundry being washed 8 while as the ozone concentration level within the washing machine decreases, there will be a corresponding increase in the amount of laundry detergent (e.g., chemistry) 70 that is added to the laundry being washed 8.

The control panel CP (or possibly the separate CPU) is preprogrammed to correspondingly adjust the amount of laundry detergent (e.g., chemistry) 70 which is to be added to the washing machine 4 depending upon the relationship between the currently detected ozone concentration level and the minimum ozone concentration level system. It is to be appreciated, however, that regardless of the currently detected ozone concentration level, at least some laundry detergent (e.g., chemistry) 70, possibly between 5-50% of the normal laundry detergent (e.g., chemistry) 70, will normally be dispensed by the automated laundry detergent dispenser 72 to every load of laundry being washed in order to ensure adequate cleaning thereof.

Figure 6:
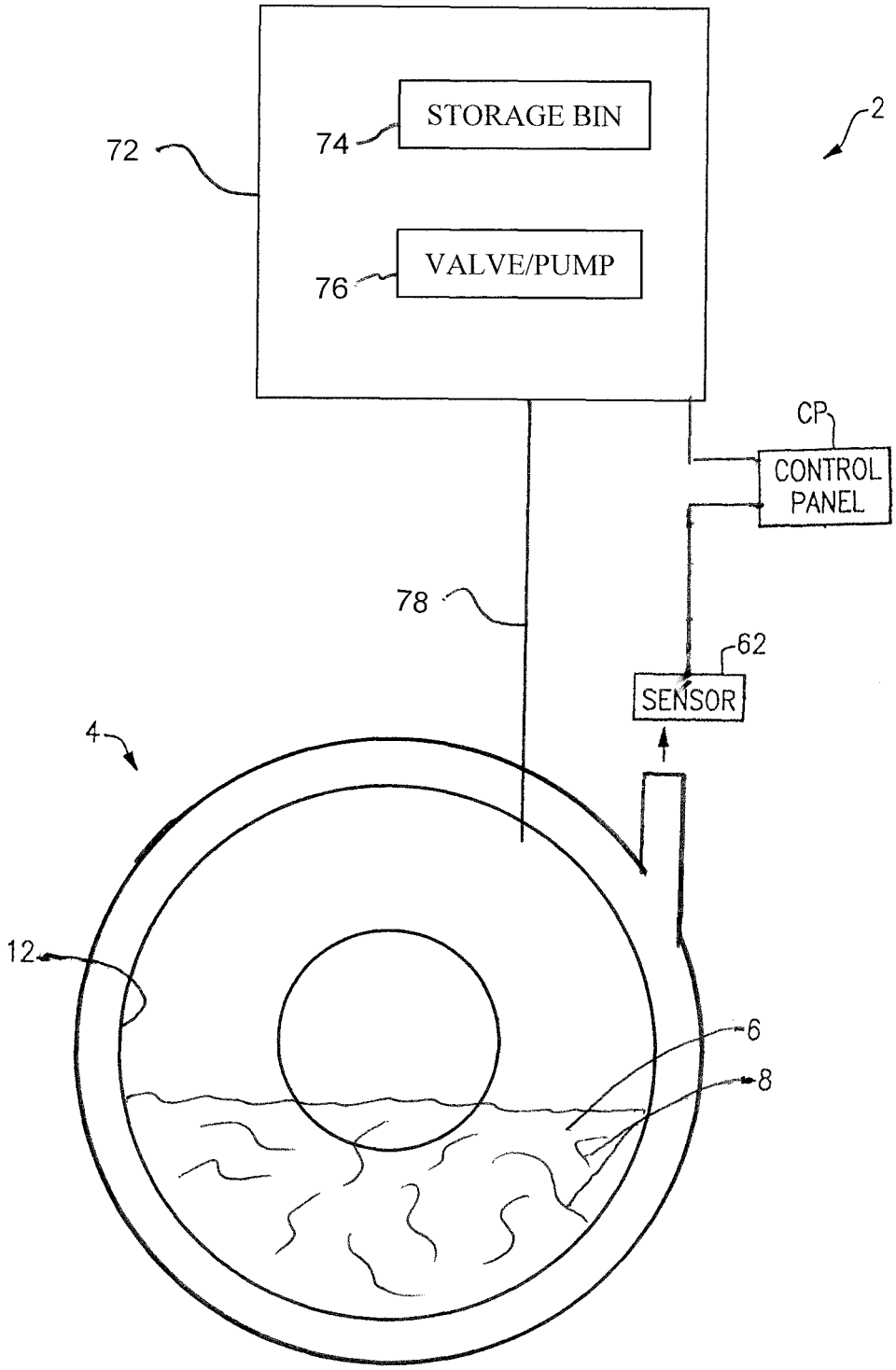
FIG. 6 diagrammatically shows the laundry detergent dispensing system, according to one embodiment, for controlling the amount of laundry detergent (e.g., chemistry) which is dispensed to the washing machine depending upon the current ozone concentration level within the washing machine.

According to the invention, as generally diagrammatically shown in FIG. 6, the control panel CP (or possibly the separate CPU) is electrically coupled to the automated laundry detergent dispenser 72 to automatically control dispensing of the laundry detergent (e.g., chemistry) 70 directly into the washing machine 4, and assist with adequate and sufficient cleaning of the laundry being washed 8. The automated laundry detergent dispenser 72 typically includes a relatively large storage bin 74 for storing a desired quantity of laundry detergent (e.g., chemistry) 70 which is to be periodically dispensed into the washing machine 4 during one or more wash stages or cycles. It is to be appreciated that the laundry detergent (e.g., chemistry) 70 may be either liquid laundry detergent or possibly powdered or solid laundry detergent. The automated laundry detergent dispenser 72 may include, a metering valve or a peristaltic pump 76 for example, which interconnects an outlet of the storage bin 74 with the water 6 contained within the washing machine 4, via a laundry chemistry supply conduit 78. Operation of the automated laundry detergent dispenser 72 is controlled by the control panel CP (or possibly the separate CPU) to facilitate accurate dispensing of a desired quantity of laundry detergent (e.g., chemistry) 70 from the storage bin 74 into the washing machine 4, during a wash, via the detergent supply conduit 78 to ensure adequate cleaning of the laundry being washed 8.

Alternatively, the control panel CP (or possibly the separate CPU) may be electrically coupled to the automated laundry detergent dispenser 72 to automatically select a desired soap one of the preset dispensing cycles, e.g., a soap dispensing cycle which dispenses 100%, 95%, 90%, 85%, 80%, 75%, 70%, 65%, 60%, 55%, 50%, etc., of a predetermined normal dose of the laundry detergent (e.g., chemistry) 70 into the washing machine 4, depending upon the currently detected ozone concentration level in the washing machine 4.

For a typical washing machine 4, the metering valve or the peristaltic pump 76 of the automated laundry detergent dispenser 72 may be preprogrammed to operate for a preset dispensing time, e.g., 2-30 second or so, typically about 10 seconds, which is generally sufficient to dispense a desired quantity of laundry detergent (e.g., chemistry) 70, e.g., the normal dose of laundry detergent (e.g., chemistry) 70, to the laundry being washed 8 within the washing machine 4. It is to be appreciated that this preset dispensing time, for dispensing the normal dose of the laundry detergent (e.g., chemistry) 70 from the automated laundry detergent dispenser 72, can vary from washing machine to washing machine as well as from application to application and is preferably adjustable by an operator of the washing machine 4 depending upon wash capacity for the washing machine, the number and the duration of the wash cycles, etc.

While it is generally known that relatively clean laundry typically requires less laundry detergent (e.g., chemistry) 70 in order to sufficiently and adequately cleaned the laundry being washed 8, while relatively dirty or soiled laundry typically requires more laundry detergent (e.g., chemistry) 70 in order to adequately cleaned the laundry being washed 8. The inventors have discovered that there is a direct correlation or proportional relationship between how rapidly/slowly the ozone concentration level within the washing machine 4 increases, following the initial introduction of ozone into the washing machine 4, to how clean/dirty the laundry being washed 8. The present invention is directed at a method and a system which determines the current ozone concentration level within the washing machine 4, typically at the time when the washing machine 4 initially requests the dispensing of the laundry detergent (e.g., chemistry) 70, or possibly after expiration of the desired preset duration of time following the first introduction of ozone into the washing machine, e.g., a duration of time of between 10 second and 180 seconds, for example. The control panel CP (or possibly the separate CPU) then utilizes the current ozone concentration level to either permit the normal dose or quantity of laundry detergent (e.g., chemistry) 70 to be dispensed, via the automated laundry detergent dispenser 72, if the currently detected ozone concentration level is relatively low, i.e., the ozone concentration level is at or below the minimum ozone concentration level, due to a relatively dirty load of laundry being determined as present in the washing machine 4, so that either no reduction or only a small reduction in the amount of laundry detergent (e.g., chemistry) 70 occurs. On the other hand, when the currently detected ozone concentration level is relatively high, i.e., the ozone concentration level is approaching or above the upper ozone concentration level, due to a relatively clean load of laundry being determined as present in the washing machine 4, a sizable reduction in the amount of laundry detergent (e.g., chemistry) 70 to be dispensed occurs, e.g., the quantity of the laundry detergent (e.g., chemistry) 70 to be dispensed by the laundry detergent dispenser 72 to the laundry being washed 8 is reduced by between 0% to 80% and more preferably between 0% and 70% and most preferably between 0% to 50%, so as to still ensure sufficient cleaning of the laundry, following completion of all of the wash cycles, without dispensing excess laundry detergent (e.g., chemistry) 70 during the wash.

The system 2 may also be equipped with an area ozone level detector or sensor 68 which monitors the level of the ozone contained within a room or an area accommodating the washing machine 4 or a plurality of washing machines 4, e.g., a laundry mat or some other commercial washing facility such as a hospital or a prison, for example. In the event that the area ozone level sensor 68 detects an excessively high or unsafe amount of ozone located within the room or the area accommodating the one or more washing machines 4, e.g., detects a room concentration level of ozone also above the ozone target value or some other common area target value, which is also currently typically in excess of 0.1 parts per million, the area ozone level sensor 68 will then convey a signal to the system 2 and reduce, or possibly temporarily interrupt, the supply of ozone from each of the ozone source(s) or generator(s) 42 to the respective washing machines 4 for a sufficient period of time, e.g., any where from a few seconds to about thirty minutes or so or possibly completely shuts down all further supply of ozone from any of the ozone sources or generators 42 until the area ozone level sensor 68 again detects a level of ozone in the room or the area accommodating the washing machine(s) 4 is below the common area target value. The sensitivity setting for the area ozone level sensor 68 is also typically adjustable but typically has a sensitivity range of between about 0.03 to about 0.1 parts per million or greater, for example.

It is to be appreciated that there are a variety of different ways for reducing/modifying/altering/interrupting the supply of ozone from or by the ozone source(s) or generator(s) 42. The important aspect is that the system 2 is controlled, in some manner, so as to reduce the supply and/or production of ozone or completely discontinue the supply of ozone until the ozone exhaust or sampling sensor 62 and/or the area ozone level sensor 68 again detects a level of ozone, below the common area target value, both within the washing machine(s) 4 and within the room or the common area.

Although the target values for the ozone exhaust or sampling sensor 62 and the area level ozone sensor 68 may both be currently 1.0 parts per million of ozone, it is to be appreciated that one or both of the ozone exhaust or sampling sensor 62 and/or the area level ozone sensor 68 could be a variable sensor. That is, as the ozone exhaust or sampling sensor 62 and/or the area level ozone sensor 68 detects the ozone level in the exhausting air or room approaching either 1.0 or 0.1 parts per million of ozone, or possibly some higher or lower level depending upon the requirements and/or the location of the sensor(s) or the settings setting of the particular sensor, the ozone sensor 62, 68 will issue a variable command to the ozone source or generator 42 which proportionally decreases or reduces the amount of ozone being produced and thereby continuously maintain a safe level of ozone which is either being exhausted from the washing machine and/or located within the room or area accommodating the washing machine(s) 4. It is to be appreciated that if the ozone sensor(s) 62 or 68 senses that the ozone level is only gradually approaching an unsafe level of ozone, the ozone sensor(s) 62 or 68 could send a signal which gradually reduces the supply or production of ozone by the ozone generator 42. If, however, the ozone sensor(s) 62 or 68 senses that the ozone level is rapidly approaching an unsafe level, the ozone sensor(s) 62 or 68 will issue a signal more rapidly reducing or possibly completely interrupting further production of ozone. Such variable control of the ozone source(s) or generator(s) 42, by the ozone exhaust or sampling sensor 62 and/or the area level ozone sensor 68, tends to minimize the duration of time, if any, that the ozone source(s) or generator(s) 42 are not actually supplying ozone to the washing machine and tends to result in a more continuous supply of ozone to the washing machine to ensure that an adequate supply of ozone is always present in the washing machine 4 during each wash cycle. That is, the ozone contained within the water 6 is generally within a control band which is typically between 50 and 100% of the ozone target value.

Typically during a commercial wash cycle, generally there are about eight sequential wash steps, stages or cycles. The first stage or cycle is typically when the greatest amount or quantity of ozone is required. During the second and subsequent wash stages or cycles, since much of the dirt, grime, grease, soil, etc., has already been partially or completely removed from the clothing or laundry being washed 8 and since much of the germs, bacteria, etc., have already been partially or completely killed, typically less ozone is required. The addition of extra ozone during the initial portion of the first wash stage or cycle assists with further "relaxing" the clothing or laundry being washed 8 such that the clothing or laundry being washed 8 more readily releases its dirt, grime, grease, soil, etc. As a result of this increase in the amount of ozone supplied during the first wash stage or cycle, a sufficient amount of ozone may still be present within the wash volume, contained within the internal drum 12, and/or within the clothing or laundry being washed 8 at the end of the first wash stage. It is to be appreciated that the filling water, during each subsequent wash cycle, may be initially ozonated prior to being added to the internal drum 12 of the washing machine 4. This filling process assists with maintaining a desired amount of ozone within the internal drum 12.

It is further to be appreciated that the ozone exhaust or sampling detector or sensor for the washing machine is installed so as to be able to sense, monitor, sample or detect the concentration level of ozone either within internal drum 12 or anywhere else within the washing machine, or in any sampling port or exhaust vent 64 associated anywhere within or on the washing machine 4 for sampling or detecting the washing machine ozone concentration level. The particular sampling port, exhaust vent or other aperture or opening is not important as long as the obtained sample or exhausted gas is not too dilute so that it does not accurately reflect the concentration level of ozone within the washing machine.

Since certain changes may be made in the above described improved ozone generating and monitoring system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A system for controlling dispensing of laundry chemistry from a laundry chemistry dispenser to a washing machine in order to minimize use of the laundry chemistry during a wash, the system comprising:

an ozone monitor configured to directly receive ozone exhausting from the washing machine and determine therefrom a current ozone concentration level in the washing machine at a time that the washing machine requires dispensing of the laundry chemistry from the laundry chemistry dispenser;

a peristaltic pump for controlling dispersing of the laundry chemistry from the laundry chemistry dispenser into the washing machine;

a control panel being coupled to the ozone monitor and configured to receive a signal from the ozone monitor indicative of the currently determined ozone concentration level in the washing machine; and the control panel being configured to control a dispensing operation of the peristaltic pump, to dispense the laundry chemistry from the laundry chemistry dispenser into the washing machine, such that the amount of the laundry chemistry to be dispensed is adjusted based upon the currently determined ozone concentration level in the washing machine.

2. The system for controlling the dispensing of the laundry chemistry from the laundry chemistry dispenser to the washing machine according to claim 1, wherein the water and ozone mixture is added into the washing machine separately from the laundry chemistry.

3. A system for controlling dispensing of laundry chemistry from a laundry chemistry dispenser to a washing machine in order to minimize use of the laundry chemistry during a wash, the system comprising:

an ozone monitor configured to directly receive ozone exhausting from the washing machine and determine therefrom a current ozone concentration level in the washing machine at a time that the washing machine requires dispensing of the laundry chemistry from the laundry chemistry dispenser;

one of a metering valve and a peristaltic pump for controlling dispensing of the laundry chemistry from the laundry chemistry dispenser into the washing machine;

a control panel being coupled to the ozone monitor and configured to receive a signal from the ozone monitor indicative of the currently determined ozone concentration level in the washing machine; and the control panel being configured to control an operation of the one of the metering valve and the peristaltic pump, to dispense the laundry chemistry from the laundry chemistry dispenser into the washing machine such that when the current ozone concentration level in the washing machine is determined to be relatively low, a greater amount of the laundry chemistry is dispensed from the laundry chemistry dispenser to the washing machine, while when the current ozone concentration level in the washing machine is determined to be relatively high, a lesser amount of the laundry chemistry is dispensed from the laundry chemistry dispenser to the washing machine.

4. The system for controlling the dispensing of the laundry chemistry from the laundry chemistry dispenser to the washing machine according to claim 3, wherein the amount of the laundry chemistry to be dispensed from the laundry chemistry dispenser is inversely proportional to the current ozone concentration level in the washing machine.

5. The system for controlling the dispensing of the laundry chemistry from the laundry chemistry dispenser to the washing machine according to claim 3, wherein when the current ozone concentration level in the washing machine is at or below a minimum ozone concentration level, then the control panel does not modify the amount of laundry chemistry to be dispensed to the washing machine.

6. The system for controlling the dispensing of the laundry chemistry from the laundry chemistry dispenser to the washing machine according to claim 5, wherein the minimum ozone concentration level ranges between 0.05 parts per million and 0.1 parts per million.

7. The system for controlling the dispensing of the laundry chemistry from the laundry chemistry dispenser to the washing machine according to claim 3, wherein when the current ozone concentration level in the washing machine is at or above an upper ozone concentration level, then the control panel still dispenses some of the laundry chemistry to the washing machine.

8. The system for controlling the dispensing of the laundry chemistry from the laundry chemistry dispenser to the washing machine according to claim 7, wherein the upper ozone concentration level ranges between 0.5 parts per million and 15 parts per million.

9. The system for controlling the dispensing of the laundry chemistry from the laundry chemistry dispenser to the washing machine according to claim 3, wherein when the current ozone concentration level in the washing machine is at or below a minimum ozone concentration level, then the control panel does not modify the amount of laundry chemistry to be dispensed to the washing machine, and when the current ozone concentration level in the washing machine is at or above an upper ozone concentration level, then the control panel still dispenses some of the laundry chemistry to the washing machine.

10. The system for controlling the dispensing of the laundry chemistry from the laundry chemistry dispenser to the washing machine according to claim 9, wherein the minimum ozone concentration level ranges between 0.05 parts per million and 0.1 parts per million, and the upper ozone concentration level ranges between 0.5 parts per million and 15 parts per million.

11. The system for controlling the dispensing of the laundry chemistry from the laundry chemistry dispenser to the washing machine according to claim 3, wherein the control panel controls an operating time of the one of the metering valve and the peristaltic pump so as to control the dispensing operation of the laundry chemistry from the laundry chemistry dispenser.

12. The system for controlling the dispensing of the laundry chemistry from the laundry chemistry dispenser to the washing machine according to claim 11, wherein the one of the metering valve and the peristaltic pump operates for a preset dispensing time of between 2-30 second which is sufficient to dispense a desired quantity of laundry chemistry into the washing machine.

13. The system for controlling the dispensing of the laundry chemistry from the laundry chemistry dispenser to the washing machine according to claim 3, wherein the washing machine comprises:

a rotatable drum for containing laundry and a quantity of a water;

an ozone generator, connected to the washing machine, for supplying ozone to the washing machine; and an ozone sampling inlet is located within the washing machine to facilitate withdrawing an ozone sample from an internal cavity of the washing machine and supplying the ozone sample to the ozone monitor.

14. The system for controlling the dispensing of the laundry chemistry from the laundry chemistry dispenser to the washing machine according to claim 13, wherein ozone monitor directly communicates with the ozone sampling inlet to facilitate monitoring the ozone within the washing machine.

15. The system for controlling the dispensing of the laundry chemistry from the laundry chemistry dispenser to the washing machine according to claim 13, wherein filling water is initially mixed with the ozone prior to supplying the ozone flowing into the washing machine.

16. The system for controlling the dispensing of the laundry chemistry from the laundry chemistry dispenser to the washing machine according to claim 3, wherein the water and ozone mixture is added into the washing machine separately from the laundry chemistry.

17. An automated method of controlling dispensing of laundry chemistry from a laundry chemistry dispenser to a washing machine in order to minimize use of the laundry chemistry, the method comprising:

loading laundry to be washed into the washing machine;

adding water to the washing machine;

mixing a supply of ozone, from an ozone source, with the water and conveying the water and ozone mixture to the washing machine;

providing one of a metering valve and a peristaltic pump for controlling dispensing of the laundry chemistry from the laundry chemistry dispenser into the washing machine;

detecting, via an ozone monitor configured to directly receive ozone exhausting from the washing machine and determine therefrom, a current ozone concentration level in the washing machine at a time that the washing machine requires dispensing of the laundry chemistry from the laundry chemistry dispenser; and adjusting, via a control panel, an amount of the laundry chemistry to be dispensed by the one of the metering valve and the peristaltic pump into the washing machine based upon the currently detected ozone concentration level such that a greater amount of the laundry chemistry is dispensed from the laundry chemistry dispenser to the washing machine when the current ozone concentration level in the washing machine is relatively low, while a lesser amount of the laundry chemistry is dispensed from the laundry chemistry dispenser to the washing machine when the current ozone concentration level in the washing machine is relatively high.

18. The automated method of controlling dispensing of the laundry chemistry from the laundry chemistry dispenser to the washing machine in order to minimize use of the laundry chemistry according to claim 17, the method further comprising adding the water and ozone mixture into the washing machine separately from the laundry chemistry.

* * * * *